US010051963B2

(12) United States Patent
Azkue et al.

(10) Patent No.: US 10,051,963 B2
(45) Date of Patent: Aug. 21, 2018

(54) SLIDING/PIVOTING MECHANISM OF A SHELF OF A PIECE OF FURNITURE OR OF A DOMESTIC APPLIANCE, DOMESTIC, APPLIANCE, AND PIECE OF FURNITURE

(71) Applicant: PAUL HETTICH GMBH & CO. KG, Kirchlengern (DE)

(72) Inventors: Mikel Azkue, Zarautz (ES); Oscar Garcia, San Sebastian (ES); Eñaut Arriaga, Ordizia (ES); Iker Lopetegi, Zarautz (ES); Unai Laskibar, Zarautz (ES)

(73) Assignee: PAUL HETTICH GMBH & CO. KG, Kirchlengem (DE)

( * ) Notice: Subject to any disclaimer, the term of this patent is extended or adjusted under 35 U.S.C. 154(b) by 0 days.

(21) Appl. No.: 15/300,416

(22) PCT Filed: Mar. 26, 2015

(86) PCT No.: PCT/EP2015/056565
§ 371 (c)(1),
(2) Date: Sep. 29, 2016

(87) PCT Pub. No.: WO2015/150220
PCT Pub. Date: Oct. 8, 2015

(65) Prior Publication Data

US 2017/0143118 A1 May 25, 2017

(30) Foreign Application Priority Data

Apr. 3, 2014 (DE) ..... 10 2014 104 733

(51) Int. Cl.
*A47L 15/50* (2006.01)
*A47B 88/497* (2017.01)
(Continued)

(52) U.S. Cl.
CPC ..... *A47B 88/497* (2017.01); *A47B 46/005* (2013.01); *A47B 88/45* (2017.01);
(Continued)

(58) Field of Classification Search
CPC ..... A47B 46/005; A47B 88/45; A47B 88/90; A47B 88/463; A47B 88/467;
(Continued)

(56) References Cited

U.S. PATENT DOCUMENTS 7,731,805 B2 * 6/2010 Banta ..... A47L 15/506 134/56 D
2008/0129168 A1 6/2008 Banta et al.
(Continued)

FOREIGN PATENT DOCUMENTS

CN 203121570 U 8/2013
DE 10 2010 036741 2/2011
(Continued)

OTHER PUBLICATIONS

Search Report issued in Int'l App. No. PCT/EP2015/056565 (dated 2015).
(Continued)

*Primary Examiner* — James Orville Hansen
(74) *Attorney, Agent, or Firm* — Barnes & Thornburg LLP

(57) ABSTRACT

The invention relates to a sliding/pivoting mechanism of a shelf of a piece of furniture or of a domestic appliance for pulling out and raising the shelf from a body of the piece of furniture or of the domestic appliance, which sliding/pivoting mechanism has at least two pivoting arms, which are fastened by means of a first end to at least one of the side walls of the body in such a way that said pivoting arms can be rotated parallel to the plane of the side walls and which are arranged parallel to each other at a distance from each
(Continued)

other, wherein at respective second ends of the pivoting arms, a guide rail is fastened in such a way that the guide rail can be pivoted parallel to the plane of the side walls and in such a way that the guide rail can be pivoted from a lower position inside the body to a raised upper position at least partially outside the body, and at least one running rail, which is linearly displacable in the guide rail and to which the shelf is fastened, wherein a damping unit that damps the traveling motion of the shelf in an end position is arranged on the sliding/pivoting mechanism. The invention further relates to a piece of furniture and to a domestic appliance having a sliding/pivoting mechanism and a domestic appliance having a damping unit, which is arranged on the pull-out guide, for damping the shelf in an end position.

10 Claims, 12 Drawing Sheets

(51) Int. Cl.

| | |
|---|---|
| ***A47B 88/45*** | (2017.01) |
| ***A47B 88/463*** | (2017.01) |
| ***A47B 88/467*** | (2017.01) |
| ***A47B 88/473*** | (2017.01) |
| ***A47B 88/90*** | (2017.01) |
| ***A47B 46/00*** | (2006.01) |
| ***F24C 15/16*** | (2006.01) |
| *A47B 88/40* | (2017.01) |

(52) U.S. Cl.
CPC ..... *A47B 88/463* (2017.01); *A47B 88/467* (2017.01); *A47B 88/473* (2017.01); *A47B 88/90* (2017.01); *A47L 15/504* (2013.01); *A47L 15/507* (2013.01); *F24C 15/168* (2013.01); *A47B 2088/401* (2017.01); *A47B 2088/901* (2017.01); *A47B 2210/175* (2013.01)

(58) Field of Classification Search
CPC ... A47B 88/473; A47B 88/497; A47L 15/504; A47L 15/507; F24C 15/168
USPC ..... 312/228.1, 228, 311, 319.1, 334.1
See application file for complete search history.

(56) References Cited

U.S. PATENT DOCUMENTS

| | | | | |
|---|---|---|---|---|
| 2012/0074080 | A1* | 3/2012 | Garcia | A47B 46/005 211/41.9 |
| 2012/0288221 | A1* | 11/2012 | Jahrling | A47B 88/044 384/20 |

FOREIGN PATENT DOCUMENTS

| | | |
|---|---|---|
| DE | 10 2011 053840 | 9/2011 |
| EP | 1991104 | 11/2008 |
| JP | 2001-017245 | 1/2001 |
| JP | 2005-087360 | 4/2005 |
| WO | WO 2007/101806 | 9/2007 |
| WO | WO 2014/033092 | 3/2014 |

OTHER PUBLICATIONS

Search Report issued in German App. No. 10 2014 104733.8 (dated 2015).

* cited by examiner

SLIDING/PIVOTING MECHANISM OF A SHELF OF A PIECE OF FURNITURE OR OF A DOMESTIC APPLIANCE, DOMESTIC, APPLIANCE, AND PIECE OF FURNITURE

CROSS REFERENCE TO RELATED APPLICATIONS

This patent application is a U.S. nationalization of International Patent Application No. PCT/EP2015/056565, filed Mar. 26, 2015, which claims priority to German Patent Application No. 10 2014 104 733.8, filed Apr. 3, 2014, the disclosures of which are incorporated herein by reference in their entireties.

The present disclosure relates to a sliding/pivoting mechanism of a shelf of a domestic appliance or of a piece of furniture for pulling out and raising the shelf from a body of the piece of furniture or of the domestic appliance. The disclosure also relates to a domestic appliance or a piece of furniture, including such a mechanism.

A class-specific sliding/pivoting mechanism as well as a domestic appliance and a piece of furniture are known from WO 2014/033092 A1.

In particular, such sliding/pivoting mechanisms are often installed in dishwashers, refrigeration units, freezers or cooking appliances in order to pull a lower dish rack, container or cooked item carrier out of the washing compartment of the dishwasher, the refrigeration or freezing compartment of a refrigerator or freezer or the cooking space of a cooking appliance and, at the same time, lift it upwards into a position which allows a user to comfortably load and unload the dish rack or cooked item carrier. In addition, a dish rack with a sliding/pivoting mechanism for a class-specific domestic appliance which can be pulled out of the body of a domestic appliance, generally horizontally, by means of runners is known from EP 1991104, for example. The use of this type of runners for cooked item carriers and containers in other class-specific domestic appliances is also known. This rack, container or cooked item carrier can thus be positioned above the rack, container or cooked item carrier and held by an equivalent sliding/pivoting mechanism.

Such domestic appliances and pieces of furniture and/or the sliding/pivoting mechanism described above have proven themselves in practice.

It is desirable to control the progress of the pull out and lift, and lower and retract movements for the respective shelves, in particularly shortly before the end position for the shelf is reached, to the effect that the shelf is prevented from abruptly striking this end position.

The sliding/pivoting mechanism according to the disclosure has at least two swivelling arms which are fastened at a first end to at least one of the side walls of the body in such a way that the swivelling arms can be rotated parallel to the plane of the side walls and which are arranged parallel to each other at a distance from each other. A guide rail is fastened at the respective second ends of the swivelling arms in such a way that the guide rail can be pivoted parallel to the plane of the side walls and in such a way that the guide rail can be pivoted from a lower position inside the body to a raised upper position at least partially outside the body. In this guide rail is a running rail which can be linearly displaced with respect to the guide rail and to which the shelf is fastened. A damping unit which damps the travelling motion of the shelf in an end position is arranged on the sliding/pivoting mechanism. It is thus possible to damp at least the movement into the end position within the body or at least the movement into the end position in the pulled out and swivelled up state. In addition, the movement of the sliding/pivoting mechanism into the lowered position can be damped.

A sliding/pivoting mechanism equipped with such a damping unit makes it possible to brake the shelf in a controlled manner before the end position is reached, for example in the body of the piece of furniture or the useable space of the domestic appliance, wherein the shelf striking its end position is prevented, in an effective manner, from damaging or in particularly breaking items which are not break-resistant such as glasses, ceramic tableware and similar, for example.

In addition, not only the generally horizontal linear movement of the shelf into its end position within the body but also the acceleration of the shelf due to gravity during lowering of the shelf from the prescribed upper position is damped.

Accordingly, a domestic appliance according to the disclosure, for example a dishwasher or a cooking appliance, has at least one runner attached to the interior of a useable space, for example a washing compartment or a cooking space, with which a shelf attached to the runner can be pulled out of the useable space, wherein the runner has at least one guide rail attached to the interior of the useable space and a running rail attached to the shelf, which can be displaced in the guide rail, with at least one support for attaching the shelf, wherein a damping unit to damp the movement of the shelf towards an end position is arranged on the guide rail. The end position inside the body and the end position in a pulled-out state can thus both be damped. The damper is preferably designed as a fluid damper with a piston and a piston rod which is arranged in or on a housing.

It is thus enabled that the shelf which can be pulled out of and pushed into the useable space of a domestic appliance, generally horizontally, can be retracted to its end position in a controlled, damped manner.

According to an embodiment, the damping unit has a damper and an activator which activates the damper. Here, the activator may be arranged on the running rail or a component which can be moved with the running rail, while the damper is arranged on the guide rail or a component connected to the guide rail. Of course, the reverse arrangement of activator and damper is also possible. The damper can also be arranged on the body, for example in the region of the back wall or on the shelf.

The damper may be designed as a fluid damper with a piston and a piston rod which is arranged in or on a housing. Gas dampers can also be used to damp raising and lowering movements.

According to another embodiment, the sliding/pivoting mechanism has a locking mechanism located on the guide rail and on one of the swivelling arms and operated through an activator assembly attached to the running rail in order to prevent the simultaneous pivoting and sliding movement of the running rail.

According to another embodiment of the disclosure, the damping unit is designed as part of a retraction and/or ejection system. This makes it possible for the user to simply initiate the pulling out of the shelf from the body of the piece of furniture or domestic appliance and the ejection mechanism pushes the shelf out of the body of the piece of furniture or domestic appliance far enough that the user does not have to reach into the washing compartment or cooking space, and the risk of contaminating or injuring the user's hand or arm by touching a dirty dish or sharp object such as a knife or similar, for example, may be avoided.

In the case of the sliding/pivoting mechanism, the activator may be positioned on the activator assembly which operates the locking mechanism. This has the advantage that an assembly which is already present can be used for the arrangement and attachment of the activator.

The activator may be designed in one piece with the holder.

The running rail may be designed in one piece with the at least one support. The running rail and the support for the shelf are preferably made from plastic so that such an activator can be injection moulded onto the running rail or the support in a simple and cost-effective manner.

DETAILED DESCRIPTION OF THE DRAWINGS

Figure 1:
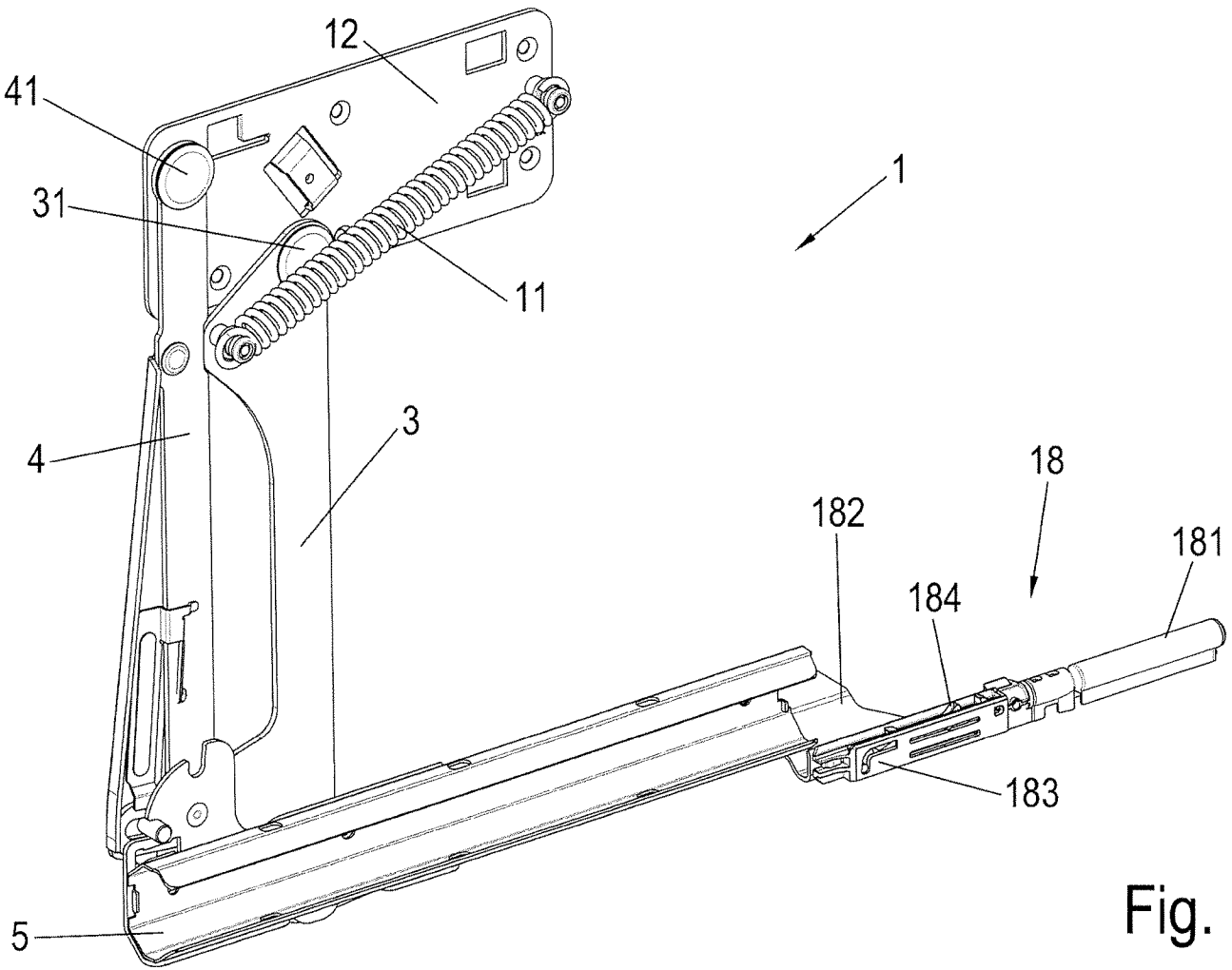
FIG. 1 is a perspective view of an embodiment of a sliding/pivoting mechanism with damping unit according to the disclosure.

In the description below, terms such as above, below, left, right, in front of, behind, etc. refer to the relative representation and position of the sliding/pivoting mechanism, swivelling arms, shelf, damping unit and similar selected in the respective figures. These terms should not be understood to be limiting, i.e. these references can change as a result of different operating positions or a mirrored design or similar.

In FIGS. 1 to 11, an embodiment of a sliding/pivoting mechanism according to the disclosure is indicated as a whole with the reference number 1. The sliding/pivoting mechanism 1 has a side wall support 12 for attaching the sliding/pivoting mechanism 1 to the interior or inner side walls of a piece of furniture or domestic appliance (not shown) in particular a dishwasher or a cooking appliance, wherein the side support 12 is attached in the case of a domestic appliance to the respective opposite inner sides of a useable space, in particular a washing compartment or cooking space.

Swivelling arms 3, 4 are swivel-mounted on this side wall support 12 using respective swivel joints 31, 41. These swivelling arms 3, 4 are swivel-mounted, using further swivel joints, to a guide rail 5 such that the guide rail 5 can be swivelled from a bottom position inside the body of the piece of furniture or domestic appliance to a raised upper position at least partially outside the body, remaining in a horizontal position, through a swivelling movement of the swivelling arms 3, 4.

The synchronisation of two such sliding/pivoting mechanisms 1 preferably occurs through a synchronisation element which is described in more detail in the aforementioned WO 2014/033092 A1, the content of which is incorporated herein by reference.

Figure 2A:
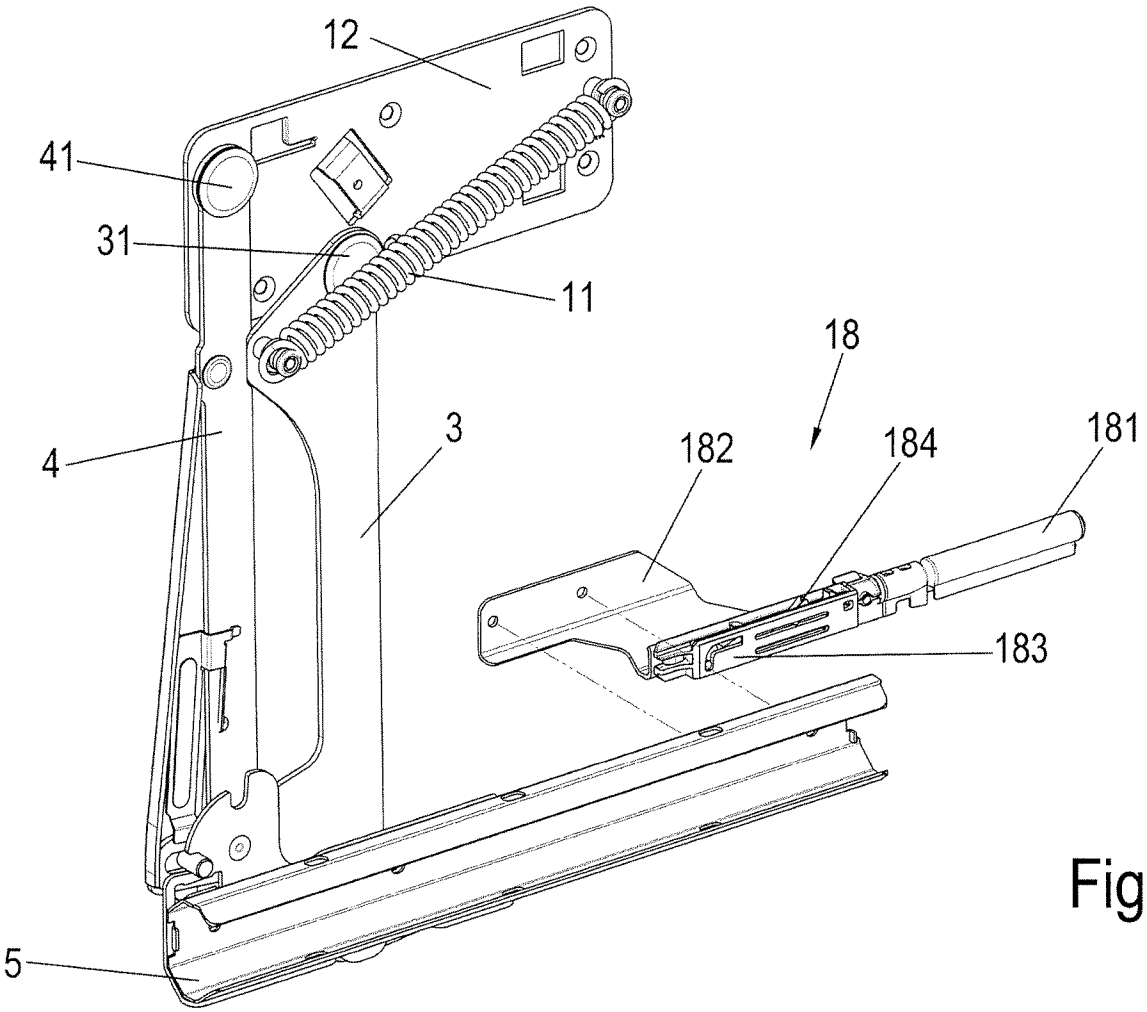
FIG. 2*a* is a perspective view of the sliding/pivoting mechanism of FIG. 1 before installation of the damping unit.
Figure 2B:
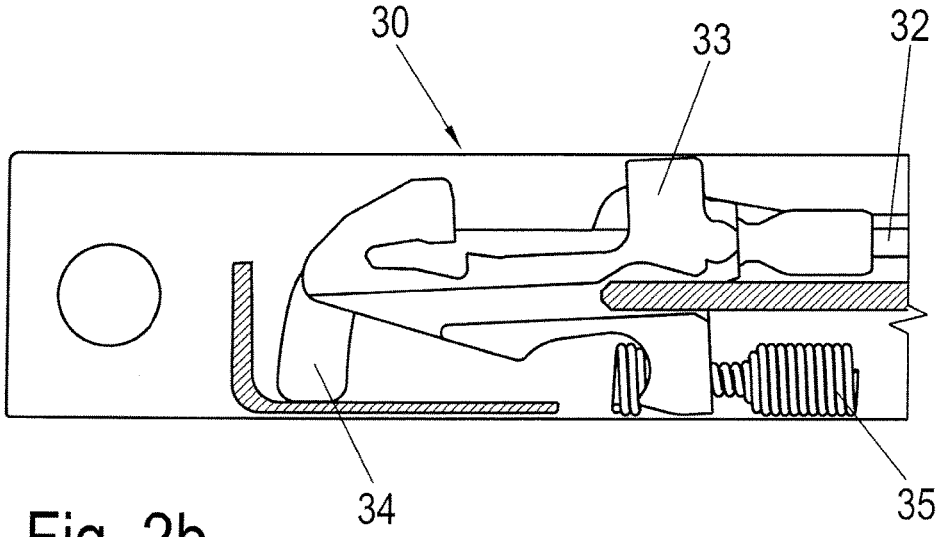
FIGS. 2*b* and 2*c* are two detail views of a damped retraction system for a sliding/pivoting mechanism according to the disclosure or for a domestic appliance according to the disclosure.
Figure 2C:
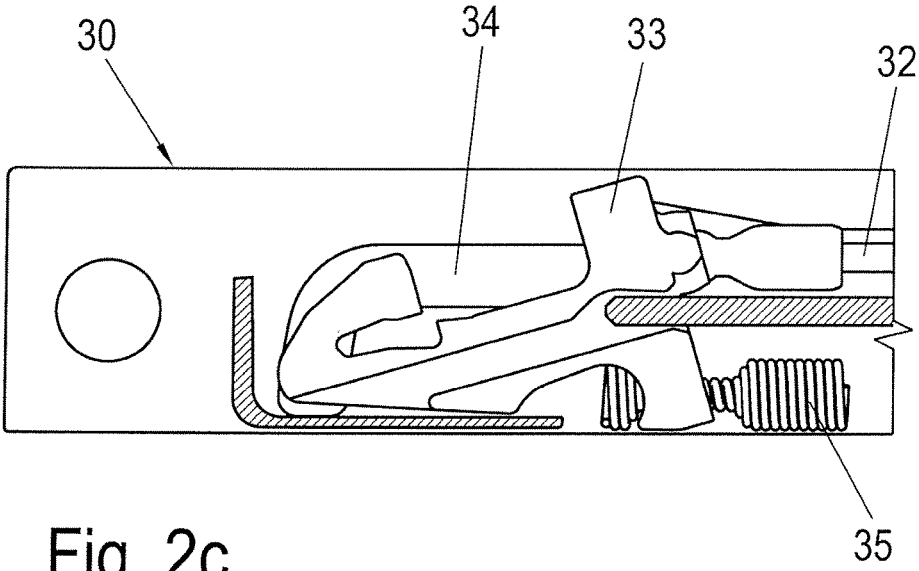
Figure 3:
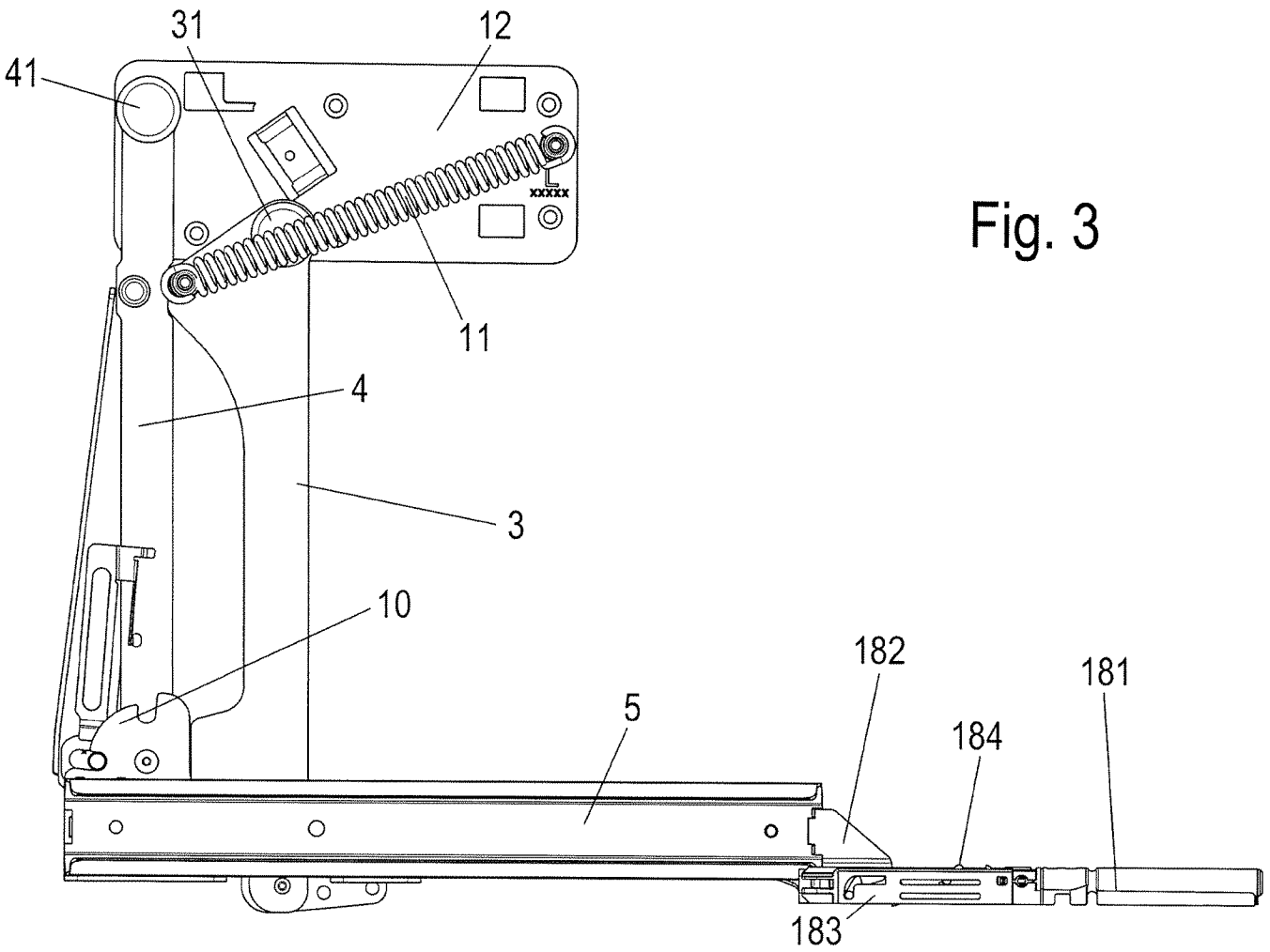
FIG. 3 is a side view of the sliding/pivoting mechanism of FIG. 1.

As additionally shown in FIGS. 1 to 3, there is a raising and lowering aid 11, preferably designed as a tension spring, for supporting the raising and lowering movement on the side wall support 12 to support the swivelling movement of the swivelling arms 3, 4 which is attached to the bolts of the side wall support 12 on the one hand and to the first swivelling arm 3 on the other.

In order to prevent the simultaneous sliding and pivoting movement of the shelf 15 and thus also of the sliding/pivoting mechanism, the sliding/pivoting mechanism 1 has a locking mechanism arranged on the guide rail 5 and on the swivelling arms 3, 4 which can be operated through an activator group 7 attached to the running rail 6. Please refer once again to the description in WO 2014/033092 A1 for a more detailed description of the locking mechanism.

In order to damp the retraction movement of the shelf 15 into a lower end position within the body, there is a damping unit 18 located on the sliding/pivoting mechanism 1 as shown in FIGS. 1 to 11. This damping unit 18 preferably has a damper 181 and an activator 185 which activates the damper 181. As shown in FIGS. 1 to 3, the damping unit 18 also has a driver 184 which can be slid into a driver housing 183, wherein the driver 184 is preferably connected to the damper 181 via a coupling rod which can be slid into and out of the damper 181 and therefore damps the movement of the driver 184 and thus also of the activator 185 which is engaged with it.

In addition to the damping unit 18, a retraction system 30 can also be used. The driver 33 is simultaneously coupled to an energy storage mechanism 35 and to a coupling rod 32 for a damper 181. A Detail of the retraction system is shown in FIGS. 2*b* and 2*c* once for a locked state and once for an unlocked state of the runner 2 in which the driver 33 passes along the guide track 34 in an angled section and the energy storage mechanism 35 is tensioned. The functioning of a damped retraction system is described in DE 102011053840 A1, for example. Here, the energy storage mechanism 35 is preferably designed as a spring element.

The driver housing 183 for the damping unit 181 is firmly connected with a fixing piece 182, as shown in FIG. 2*a*, which for its part is attached to the guide rail 5, for example with screws or bolts or even welded. As can also be seen in FIG. 2, this fixing piece 182 is preferably designed as a sheet metal component which is adapted to the geometry of the guide rail 5 and which, in the design variant shown here, encompasses it from below and is attached to the guide rail 5 on the side of it which faces the side wall of the body.

As shown in FIGS. 4 to 10, the activator 185 may be attached to the activator assembly 7 or be fabricated in one piece with the activator assembly 7. The activator assembly can also have fixing elements for the attachment of the shelf 15 to the runner 2 at the same time. Fixing of the activator 185 to the running rail 6 or another component which can be moved with the running rail 6, for example the shelf 15, is also possible.

Figure 8:
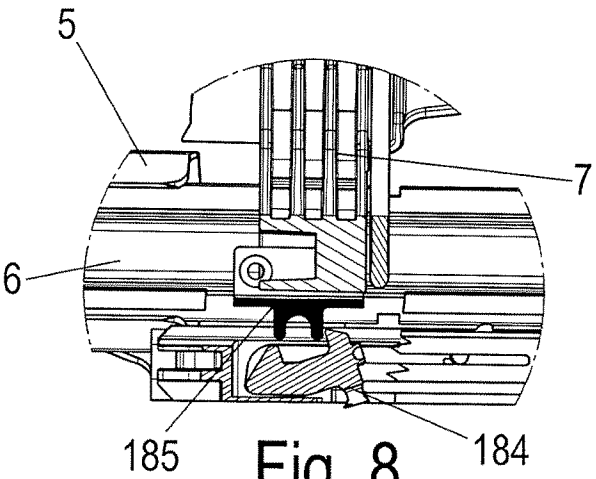
FIG. 8 is a detailed representation of the section labelled with VIII in FIG. 7.
Figure 9:
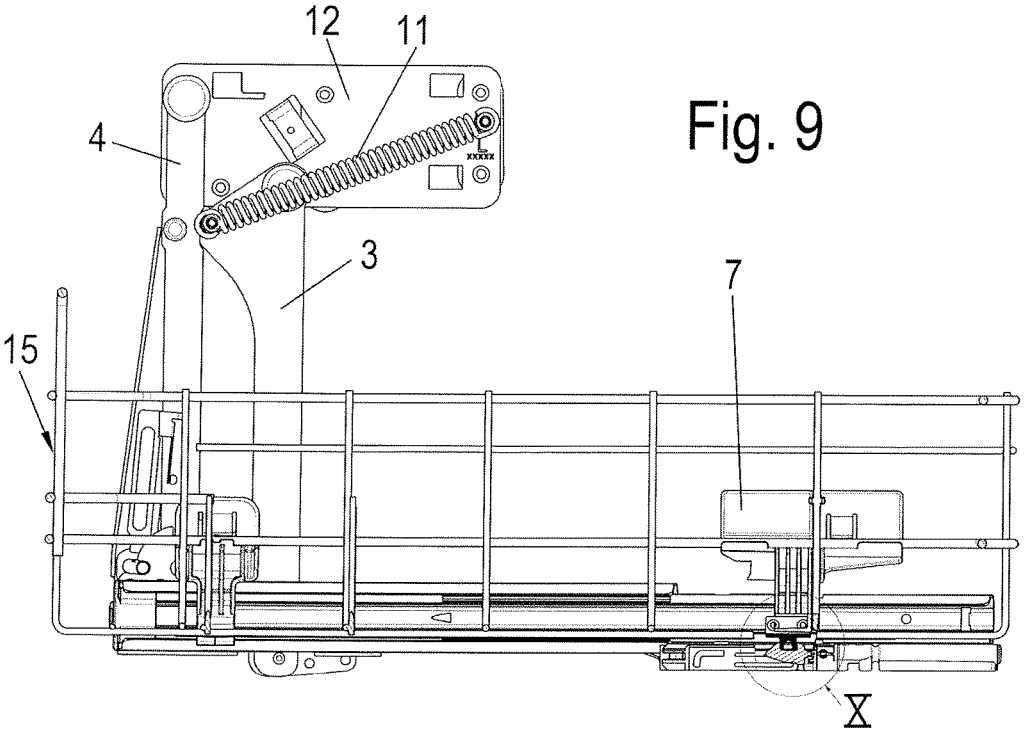
FIG. 9 is a side view of the sliding/pivoting mechanism with shelf attached to it in its fully retracted end position in the body of the piece of furniture or domestic appliance.
Figure 10:
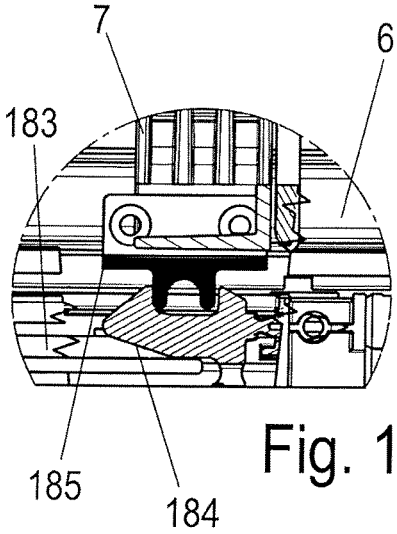
FIG. 10 is a detailed representation of the section labelled with X in FIG. 9.

In this embodiment, the activator 185 has ridges protruding downwards toward the driver 184 which, in the state shown in FIGS. 9 and 10, engage with a recess in the driver 184 which faces the activator 185. The driver 184 is guided in a guide track in the driver housing 183 which allows for tipping of the driver 184 at one end, in which the activator 185 can be released from or put into its state of engagement with the driver 184, as shown in FIGS. 7 and 8.

Figure 4:
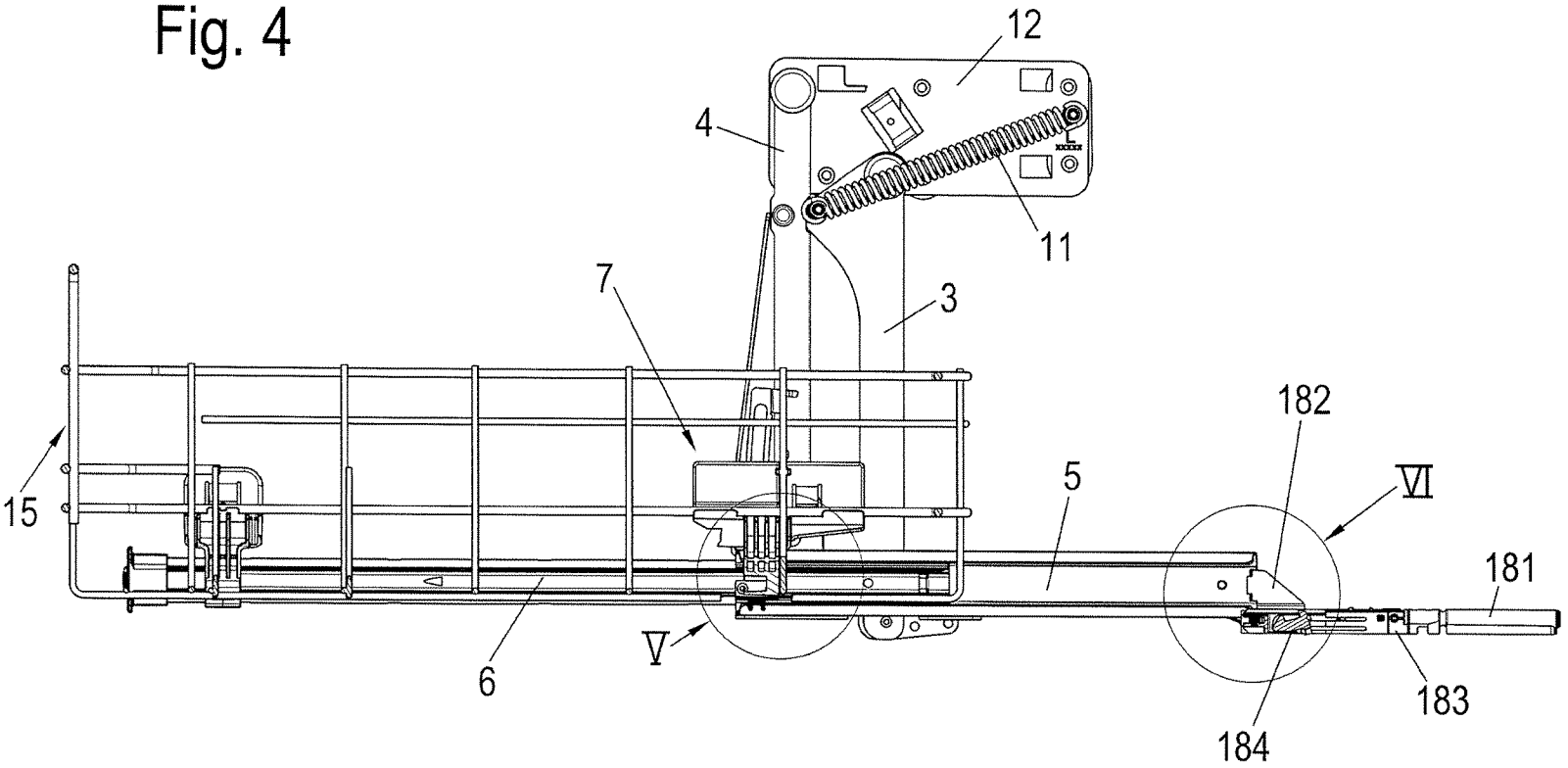
FIG. 4 is a side view of the sliding/pivoting mechanism of FIG. 1 with shelf attached to it with running rails pushed out of the guide rails after lowering of the shelf back down.
Figure 5:
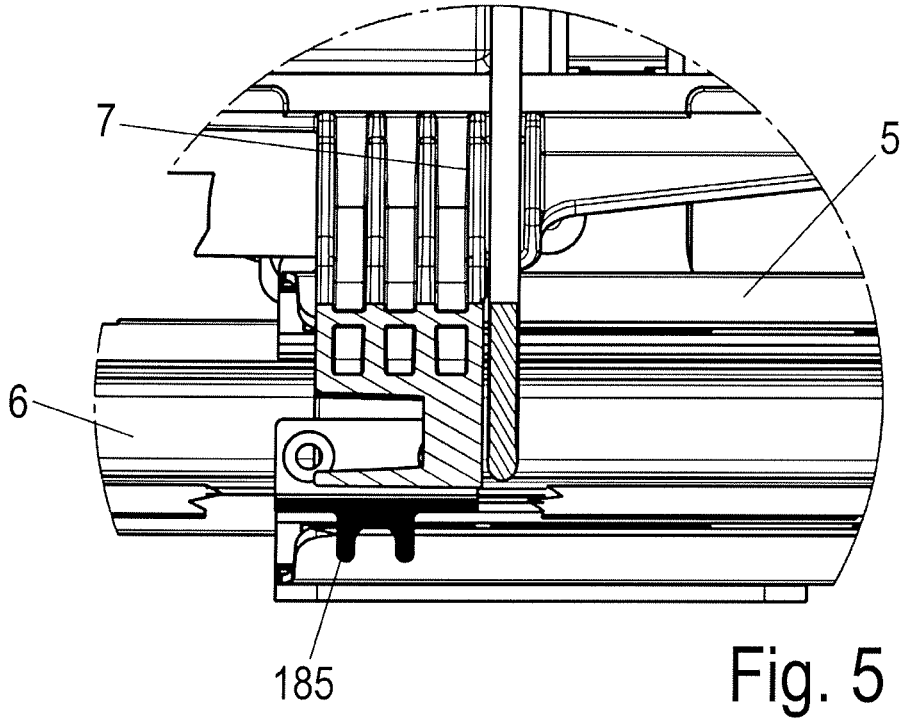
FIGS. 5 and 6 are respective sections, labelled with V and VI in FIG. 4, for showing the position of the activator and the driver for the damping unit.
Figure 6:
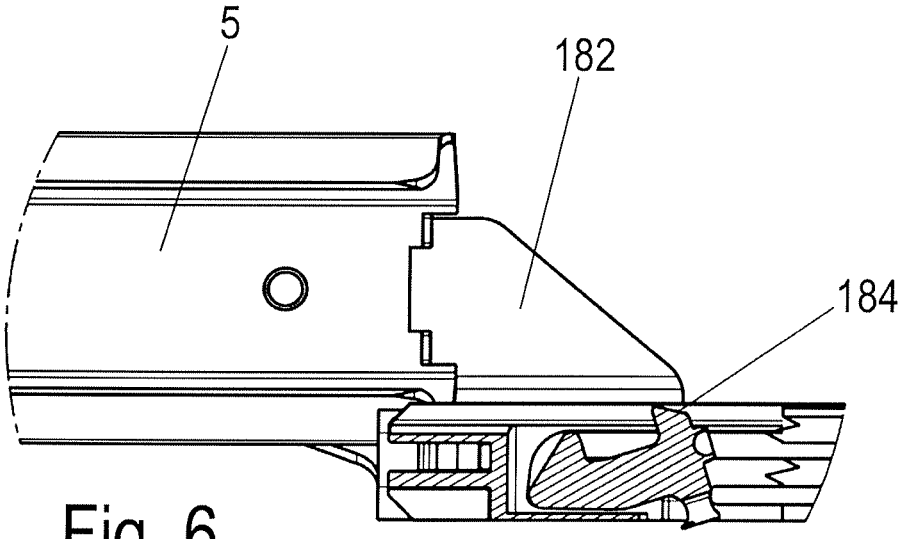
Figure 7:
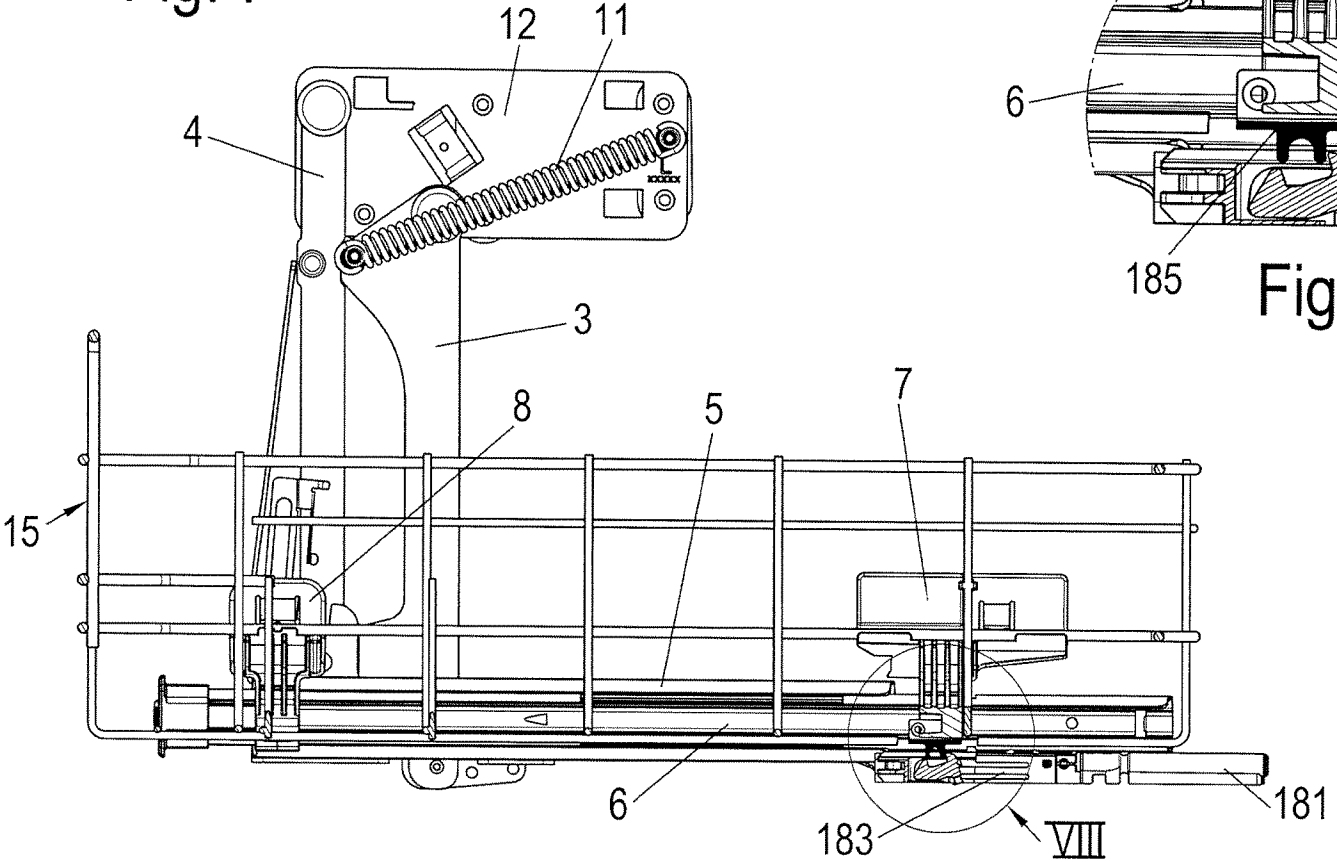
FIG. 7 is a side view of the sliding/pivoting mechanism with shelf attached to it shortly before reaching the end position in the body of the piece of furniture or domestic appliance during coupling of the activator with the driver for the damping unit.

FIGS. 4 to 6 show the pulled out position of the shelf 15 in which the activator 185 is separated from the driver 184 and the driver 184, as shown in the detail view in FIG. 6, remains in the tilted position until the shelf 15 and thus the running rail 6 and the activator assembly 7 are pushed back into the driver 184 area, shown in FIGS. 7 and 8, in which the activator 185 enters back into the recess in the driver 184 and proceeds, together with the driver 184, in the guide track 183 to the end position within the body of the piece of furniture or domestic appliance (shown in FIGS. 9 and 10) and the retraction movement thus occurs with damping as a result of the coupling of the driver 184 with the damper 181. If a retraction system 30 with damping unit 18 according to FIGS. 2*b* and 2*c* is used, then additional support is provided for the retraction movement.

Figure 11:
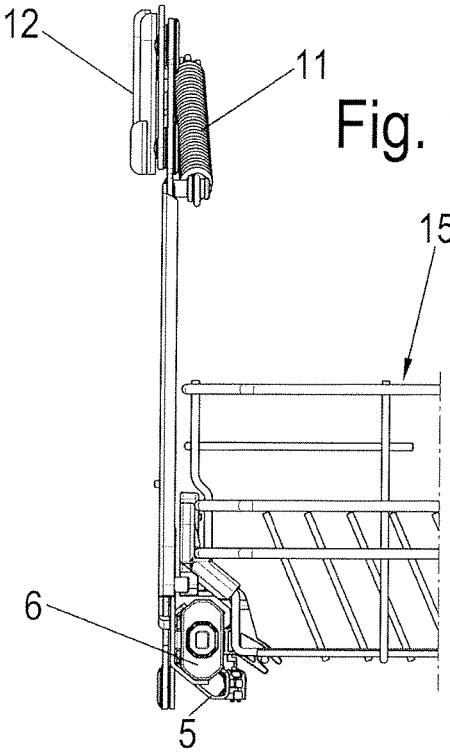
FIG. 11 is a view of the sliding/pivoting mechanism with shelf attached to it from the front.

FIG. 11 shows the sliding/pivoting mechanism 1 with the shelf 15 attached to it from the front.

Another embodiment of the domestic appliance is described below with reference to FIGS. 12 to 17.

Figure 12:
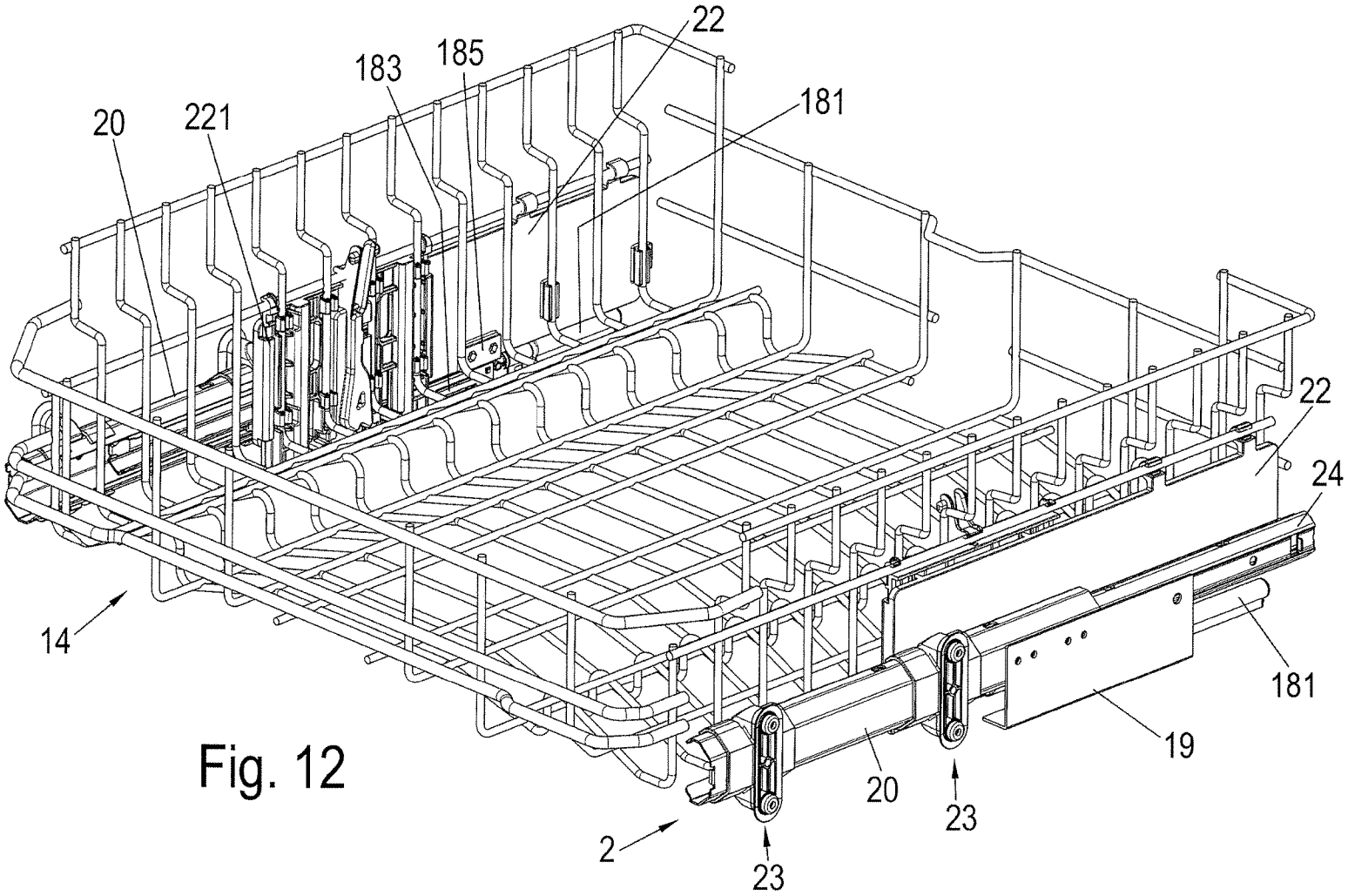
FIG. 12 is a perspective view of a shelf of a domestic appliance attached to a runner.
Figure 13:
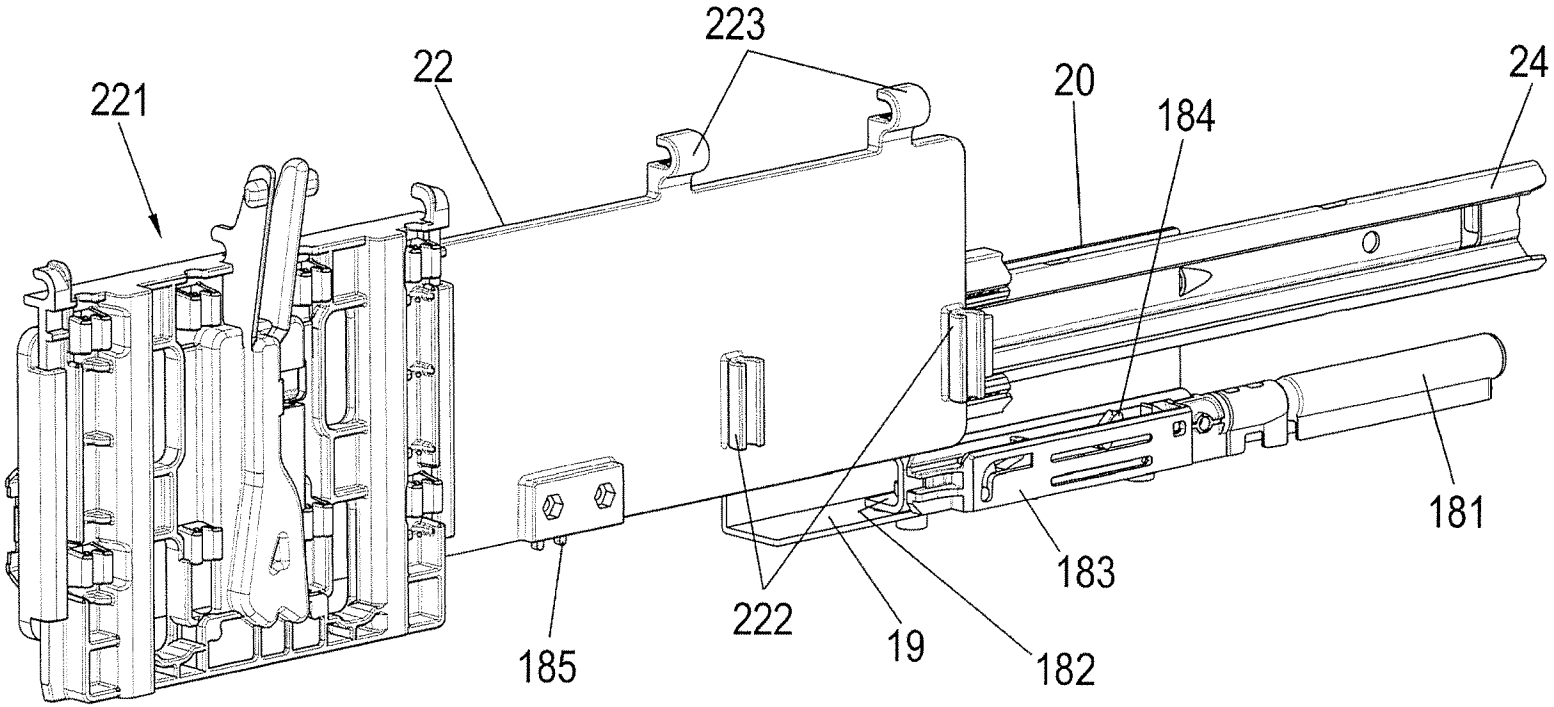
FIG. 13 is a perspective view of the runner.

In FIG. 12, a runner is labelled with the reference number 2. Such a runner 2 is attached to each of the inner sides respectively of a useable space, in particular a washing compartment or a cooking space in a domestic appliance. A shelf 14 is attached to the runners 2, wherein the shelf 14 can be pulled out of and pushed into the useable space with the help of the runners 2 located on both sides.

The runner 2 has a guide rail 20 attached to the inner side of the useable space and a running rail 21 which is attached to the shelf 14 and can be displaced in the guide rail 20, wherein at least one support 22 for attaching the shelf 14 is arranged on the running rail 21. In the embodiment shown in FIGS. 12 to 17, the damping unit 18 can be attached to the guide rail 20 through a preferably L-shaped fixing element 19. Fixing elements 23 are also fixed on the guide rail 20, which partially engage with the guide rail 20 and can be fixed, in particular with screws, to the inner side of the useable space of the domestic appliance.

Figure 17:
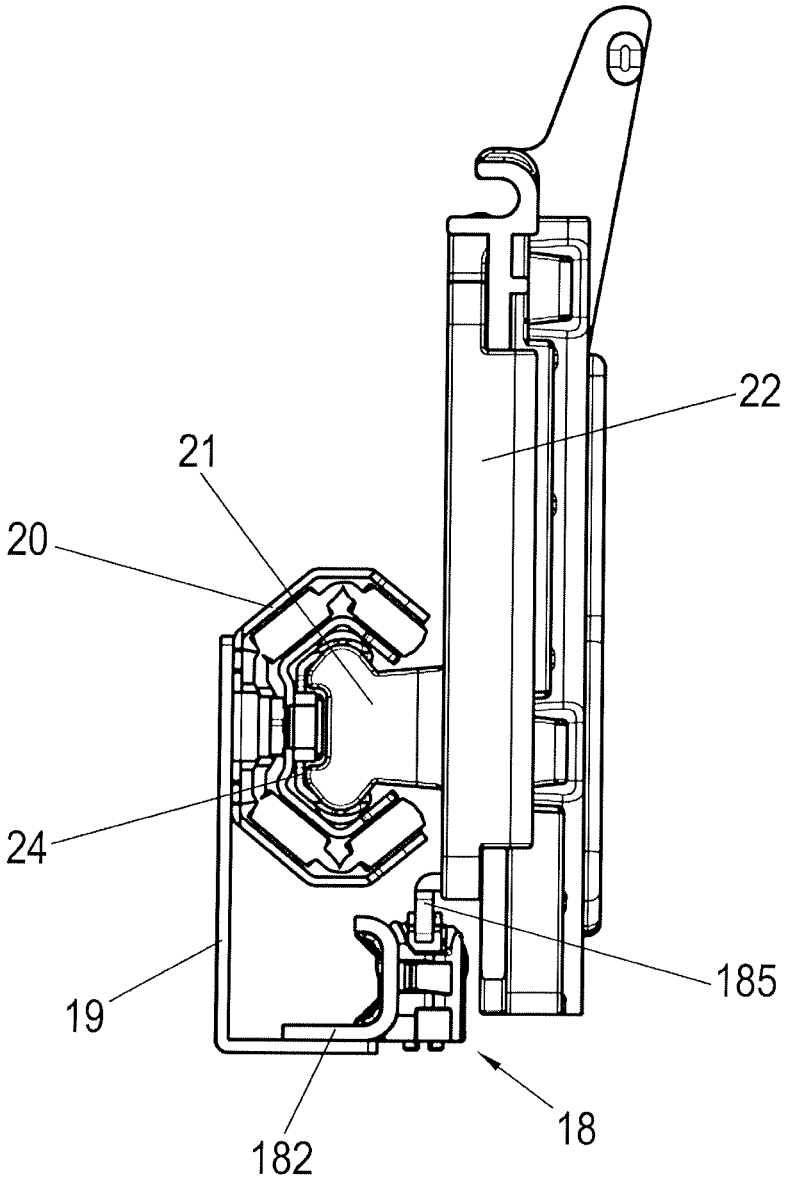
FIG. 17 is a view of the runner shown in FIG. 13 from the front.

In this embodiment, the runner 2 also, as shown in FIG. 17 for example, has a centre rail 24 which can be moved in the guide rail 20 and which movably accommodates the running rail 21. The running rail is preferably designed as one piece with the support 22, wherein the support 22 is used to attach the shelf 14. To this end, there are multiple clamping or fixing elements 221, 222, 223 on the support 22 which are used to attach the beam elements of the shelf 14, designed here as a wire basket. In addition, the support 22 can be designed so that the height of the shelf 14 is adjustable.

As can be seen in FIGS. 13 to 17 in particular, a damper 181 with driver housing 183 attached to it using a connecting piece 182 is fixed to the fixing element 19. An activator 185 is thus positioned on the support 22. The positioning of the activator 185 on the support 22 is preferably through the fixing, in particular clamping, of an activator 185 designed as a separate component in a recess in the support 22 designed for this purpose. However, it is also possible to embody the activator 185 as one piece with the support 22. The damping unit 18 arranged on the runner 2 in this manner preferably corresponds to the damping unit 18 for the sliding/pivoting mechanism as described above. Here too, the damping unit 18 is used for damping the retraction movement of the shelf 14 into its end position within the useable space of the domestic appliance.

Figure 14:
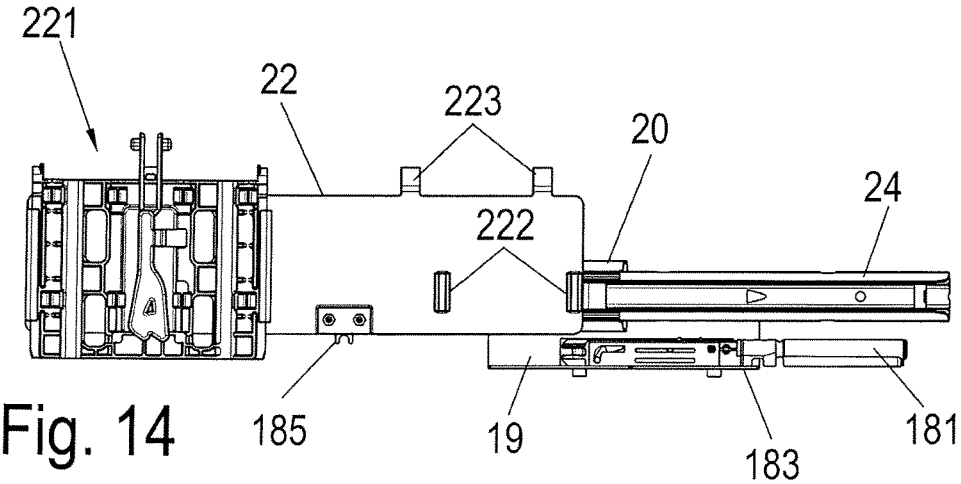
FIGS. 14 to 16 are side views of the runner in a variety of positions.
Figure 15:
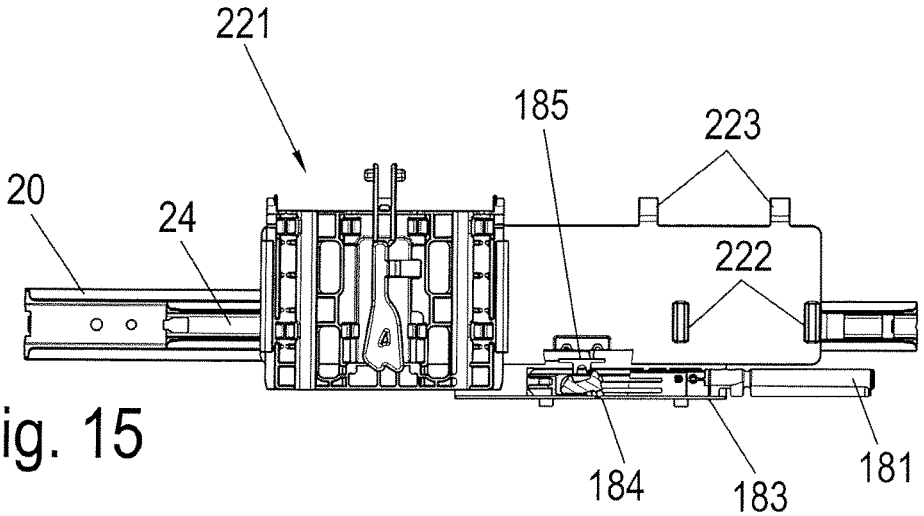
Figure 16:
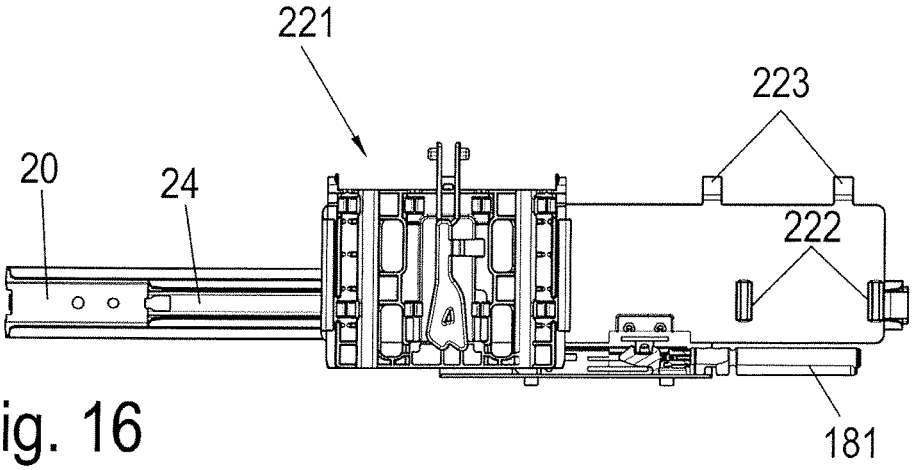

FIGS. 14 to 16 show the sequence of a retraction movement of the shelf 14 or the shelf 14 moving with the support 22 into its end position.

FIG. 14 shows the pulled out state in which the activator 185 is uncoupled from the driver 184 of the damping unit 18.

FIG. 15 shows the position of the support 22 and thus of the shelf 14 in which the activator 185 couples with the driver 184 of the damping unit 18.

For the subsequent movement of the shelf 14 into its end position, the driver 184 is tilted in the driver housing 183 from the tipped position into the position for engaging with the activator 185 and moved into the end position, as shown in FIG. 16, damped by the damper 181.

FIG. 17 shows the runner 2 or the shelf 14 attached to it in a view from the front before the coupling of the activator 185 with the driver 184 of the damping unit 18.

In addition to the damping unit 18, a retraction system 30 can also be used. The driver 33 is simultaneously coupled to an energy storage mechanism 35 and to a coupling rod 32 for a damper 181. A Detail of the retraction system is shown in FIGS. 2*b* and 2*c* once for a locked state and once for an unlocked state of the runner 2 in which the driver 33 passes along the guide track 34 in an angled section and the energy storage mechanism 35 is tensioned. The functioning of a damped retraction system is described in DE 102011053840 A1, for example. If a retraction system 30 with damping unit 18 according to FIGS. 2*b* and 2*c* is used, then the retraction movement is additionally supported. The energy storage mechanism 35 is preferably embodied as a spring element.

The runner 2 can be designed as part of an ejection system, resulting in the benefits indicated in the introductory section.

At least part of the runner and the damping unit 18 may be made from stainless steel in order to withstand the conditions which occur in a domestic appliance such as a dishwasher or a cooking appliers, such as high heat, moisture, salt, detergents and grease.

The invention claimed is:

1. A sliding/pivoting mechanism of a shelf of a piece of furniture or of a domestic appliance for pulling out and raising the shelf from a body of the piece of furniture or of the domestic appliance, the sliding/pivoting mechanism having at least two swivelling arms which are pivotally fastened at respective first ends to a side wall of the body in such a way that the swivelling arms can be rotated parallel to the plane of the side wall, and which are arranged parallel to each other at a distance from each other, a runner comprising a guide rail and at least one running rail, wherein the guide rail is pivotally fastened to respective second ends of the swivelling arms in such a way that the guide rail can be displaced parallel to the plane of the side wall and in such a way that the guide rail can be displaced from a lower position inside the body to a raised upper position at least partially outside the body, and wherein the at least one running rail is linearly displaceable in the guide rail, an activator assembly attached to the running rail, the activator assembly comprising an activator arranged on the running rail and fixing elements configured to attach the shelf to the at least one running rail, and a damping unit which damps the travelling motion of the shelf at an end position, the damping unit having a damper arranged on the guide rail and configured for actuation by the activator.

2. The sliding/pivoting mechanism according to claim 1, wherein the damping unit is part of a retraction system.

3. The sliding/pivoting mechanism according to claim 1, wherein the running rail is in one piece with at least one support, wherein the activator is arranged on the at least one support.

4. The sliding/pivoting mechanism according to claim 3, wherein the activator is in one piece with the at least one support.

5. A piece of furniture with a furniture body and at least one shelf mounted in the furniture body with a sliding/pivoting mechanism according to claim 1 with which the shelf can be pulled out of the furniture body and raised.

6. A domestic appliance with at least one shelf attached to the inner side of a useable space, the at least one shelf using a sliding/pivoting mechanism according to claim 1 with which the shelf can be pulled out of the useable space and raised.

7. A domestic appliance having a body defining a useable space, the body including a side wall, the domestic appliance comprising:

a shelf, a sliding/pivoting mechanism for pulling and raising the shelf, the sliding/pivoting mechanism having at least two swivelling arms which are pivotally fastened at respective first ends to a side wall of the body in such a way that the swivelling arms can be rotated parallel to the plane of the side wall, and which are arranged parallel to each other at a distance from each other, a runner comprising a guide rail and at least one running ran, wherein the guide rail is pivotally fastened to respective second ends of the swivelling arms in such a way that the guide rail can be displaced parallel to the plane of the side wall and in such a way that the guide rail can be displaced from a lower position inside the body to a raised upper position at least partially outside the body, and wherein the at least one running rail is linearly displaceable in the guide rail, an activator assembly attached to the running rail, the activator assembly comprising an activator arranged on the running rail and fixing elements configured to attach the shelf to the at least one running rail, and a damping unit which damps the travelling motion of the shelf at an end position, the damping unit having a damper arranged on the guide rail and configured for actuation by the activator.

8. The sliding/pivoting mechanism according to claim 7, wherein the damping unit is part of a retraction system.

9. The sliding/pivoting mechanism according to claim 7, wherein the running rail is in one piece with at least one support, wherein the activator is arranged on the at least one support.

10. The sliding/pivoting mechanism according to claim 9, wherein the activator is in one piece with the at least one support.

* * * * *